US005575385A

United States Patent [19]

Zona

[11] Patent Number: 5,575,385

[45] Date of Patent: Nov. 19, 1996

[54] PACKAGE FOR CIGARETTES AND THE LIKE, METHOD FOR THE PRODUCTION OF THIS PACKAGE AND APPARATUS FOR CARRYING OUT THIS METHOD

[75] Inventor: Mauro Zona, Turin, Italy

[73] Assignee: G.D. Societa' per Azioni, Bologna, Italy

[21] Appl. No.: 396,731

[22] Filed: Mar. 1, 1995

[30] Foreign Application Priority Data

Mar. 3, 1994 [IT] Italy ..... TO94A0145

[51] Int. Cl.[6] ..... B65B 19/02; B65D 85/10

[52] U.S. Cl. ..... 206/256; 53/539; 206/443; 493/910; 493/966

[58] Field of Search ..... 206/443, 257, 206/256, 258; 229/87.13, 87.12, 87.03; 220/507; 493/910, 911, 912, 966; 53/246, 263, 539

[56] References Cited

U.S. PATENT DOCUMENTS

| | | | |
|---|---|---|---|
| 1,224,996 | 5/1917 | Baldwin | 206/256 |
| 2,792,962 | 5/1957 | Granfelt | 206/443 X |
| 3,033,419 | 5/1962 | Lebach | 206/257 X |
| 3,101,652 | 8/1963 | Imielinski | 493/912 X |
| 3,996,087 | 12/1976 | May et al. | 493/966 X |
| 4,184,591 | 1/1980 | Geldmacher | 206/443 X |
| 4,950,218 | 8/1990 | Tsuru et al. | 493/966 X |
| 5,005,698 | 4/1991 | Mikhail | 206/257 |

*Primary Examiner*—James F. Coan

*Attorney, Agent, or Firm*—Sughrue, Mion, Zinn, Macpeak & Seas

[57] ABSTRACT

A package for cigarettes and the like comprises a honeycomb structure which defines a plurality of elongated parallel cells each for receiving a respective cigarette. The structure includes two opposite walls which close said cells at their ends, one of these end walls being adapted to be opened to low access to the cells containing the cigarettes.

3 Claims, 11 Drawing Sheets

FIG. 3
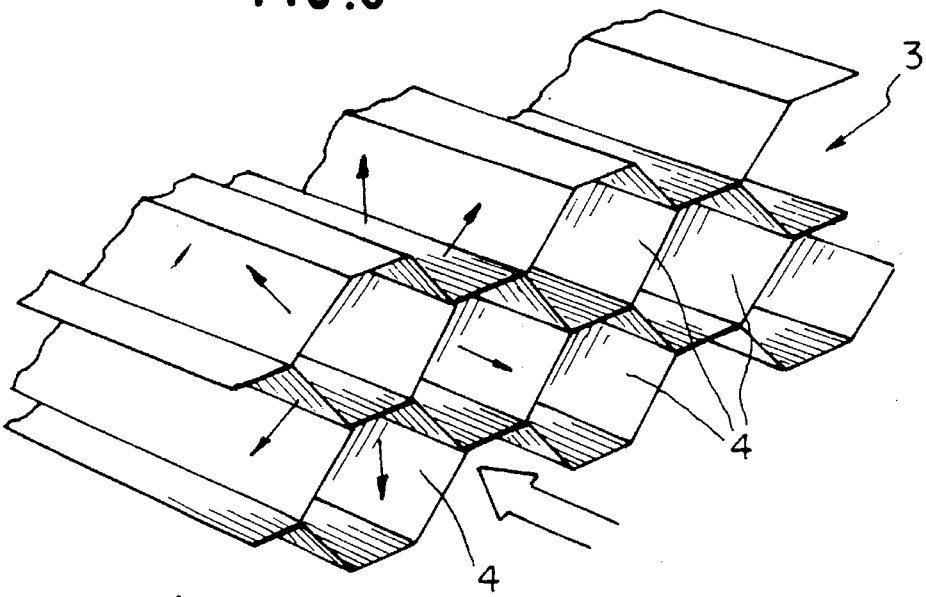
FIG. 4
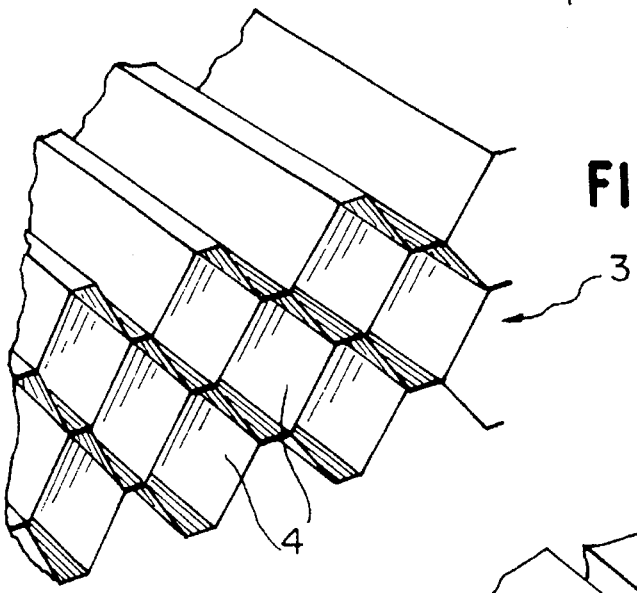
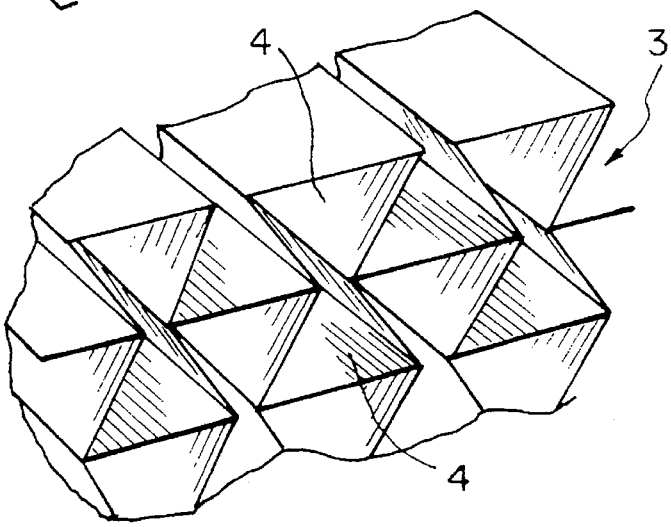
FIG. 5

PACKAGE FOR CIGARETTES AND THE LIKE, METHOD FOR THE PRODUCTION OF THIS PACKAGE AND APPARATUS FOR CARRYING OUT THIS METHOD

FIELD OF THE INVENTION

The present invention is directed to a new package for cigarettes and the like, as well as to a method and an apparatus for the production of this package.

SUMMARY OF THE INVENTION

The main feature of the package according to the invention lies in that it comprises a honey-comb structure which defines a plurality of elongated parallel cells, each for a respective cigarette, said structure further including two opposite walls which close said cells at their ends, at least one of said end walls being adapted to be opened for allowing access to said cells.

Preferably, said end wall which can be opened has pre-cut lines which enable the removal only of the portion of this wall which closes each single cell.

In a preferred embodiment, the honey-comb structure is comprised of a plurality of sheets superimposed on each other, which are mutually bonded along strip portions thereof which are spaced apart from each other, said sheets being spaced apart from each other between two adjacent strip portions, so as to define said cells, according to a honey-comb general arrangement. In this preferred embodiment, said sheets and said end walls are comprised of light cardboard, paper or the like, but also other materials may obviously be used.

The package according to the invention is characterized by a number of relevant advantages, which are not indicated herein according to their order of importance:

The structure of the package according to the invention has a high rigidity along the longitudinal dimension of the cells, which protects the integrity of each cigarette.

The package provides a single package for each cigarette, which ensures that the flavour is kept and always keeps the cigarettes within the package in order and protected, also when some of the cigarettes of the package have been used. This substantially distinguishes the package according to the invention from the conventional packages for cigarettes, wherein the larger and larger free space which is originated by the use of the cigarettes in the package gives rise to a continuous beating of the cigarettes which are left in the package, which results in a loss of tobacco, in possible aesthetically unpleasant deformations of the single cigarettes and in a loss of flavour.

The package according to the invention also allows for an immediate check of the number of cigarettes which are left in the package.

The structure of the package according to the invention is further adapted to be easily divided into portions, as it will appear more clearly from the description of the preferred embodiment which will be provided hereinafter, which also provides a further convenience for the users.

The structure of the package also lends itself to assume a large number of different shapes, the rigidity of the whole unit being independent from the total dimensions.

The package according to the invention is able to be produced with a structure which does not require an inner layer of aluminium foil or an outer protecting cover.

The structure of the package according to the invention is also able to be used as a container of big size, to be used as a service container for supplying a container of lower size.

It is also to be noted that the dimensional indefiniteness of said container enables the same to fulfil the function which is traditionally provided by the conventional cigarette carton. With the invention, the "carton" is indeed composed of an uninterrupted series of n packages, connected to each other. Therefore, also the conventional package machines for producing the cartons become superfluous.

Finally, the structure of the package according to the invention enables various aesthetically appealing shapes to be provided.

As already indicated above, the invention also provides a method and an apparatus for the production of the above described package, according to what is indicated in the annexed claims.

BRIEF DESCRIPTION OF THE DRAWINGS

Further features and advantages of the invention will become apparent from the description which follows with reference to the annexed drawings, given purely by way of non limiting example, wherein:

FIGS. 1–3 and 6–9 diagrammatically show subsequent stages of the method for manufacture of a preferred embodiment of the package according to the invention, FIGS. 4, 5 show two variants of FIG. 3.

DETAILED DESCRIPTION OF THE INVENTION

With reference to the drawings, the structure of the cigarette package according to the invention will be described in the following by referring to a possible sequence of operations which can be carried out to obtain the package according to the invention.

Figure 1:
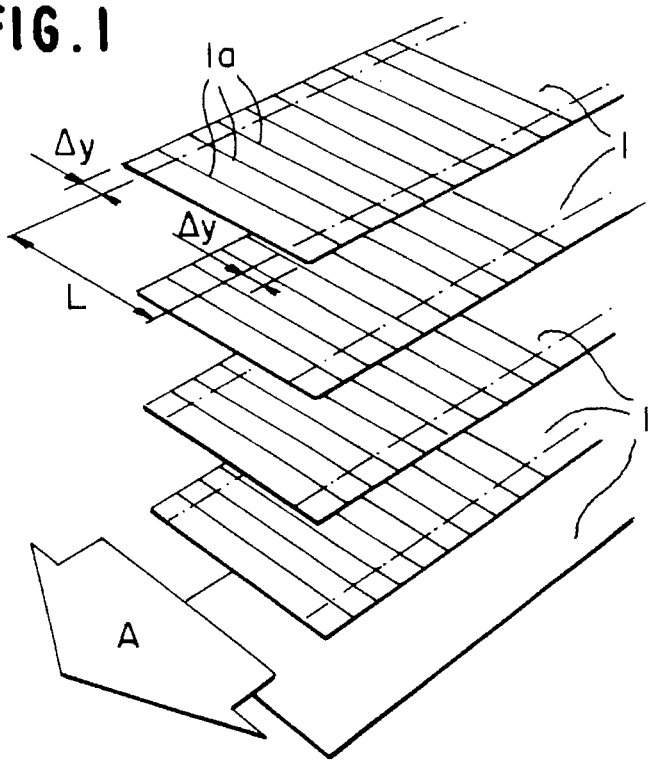

With reference to FIG. 1, in order to manufacture the package according to the invention, sheets 1 are provided which are parallel and superimposed to each other, each having an elongated shape in form of a band and a width equal to the length L of the cigarettes which are to be packaged, increased by $2\Delta y$, where $\Delta y$ is computed according to a rule which will become apparent in the following. Each band 1, which, as indicated, may be for example of light cardboard or of any other suitable material, has a plurality of transverse folding lines la provided at a constant pitch or at a variable pitch which is cyclically repeated.

Figure 2:
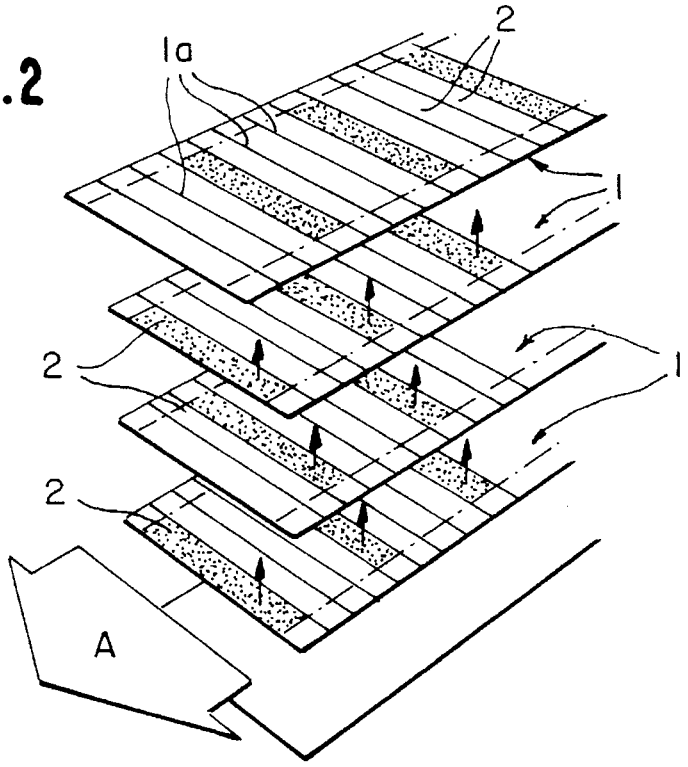

With reference to FIG. 2, supposing for simplicity that the pitch between lines la is constant, these lines define a plurality of strip portions 2. As the bands 1 are advanced in the direction of arrow A, there are formed bonding or heat-welding areas on a series of strip portions 2 which are spaced apart from each other, in the case of the illustrated example, by intervals of three strip portions. This can be done, for example, by depositing self adhesive strips on the strip portions 2 which must become bonding areas. As shown in FIG. 2, however, the end portions of each strip 2 corresponding to the above indicated Δy are left free of glue.

As the bands 1 advance, the latter are mutually bond at the bonding strips 2, whereas at the strips which are not glued the bands 1 are again separated, for example by a transverse air jet, so as to obtain the elongated body which is diagrammatically illustrated in FIG. 3 and designated by 3, having a honey-comb general shape and comprising a plurality of cells 4 having an elongated shape, parallel to each other.

FIGS. 4, 5 show two possible variants of the structure 3, which can be obtained with a different arrangement of the bonding strips 2.

Figure 6:
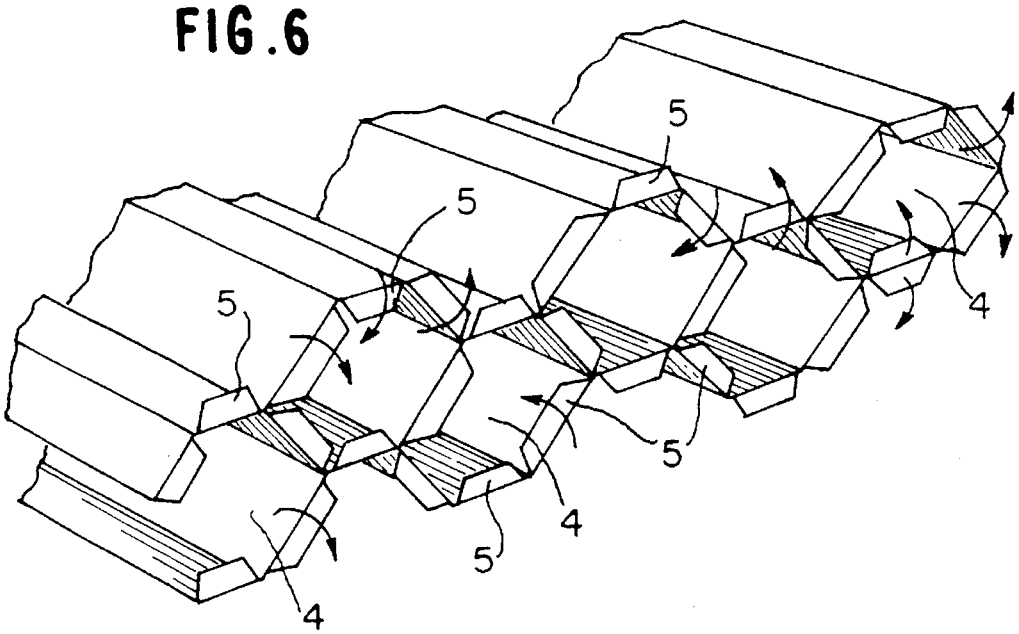
Figure 7:
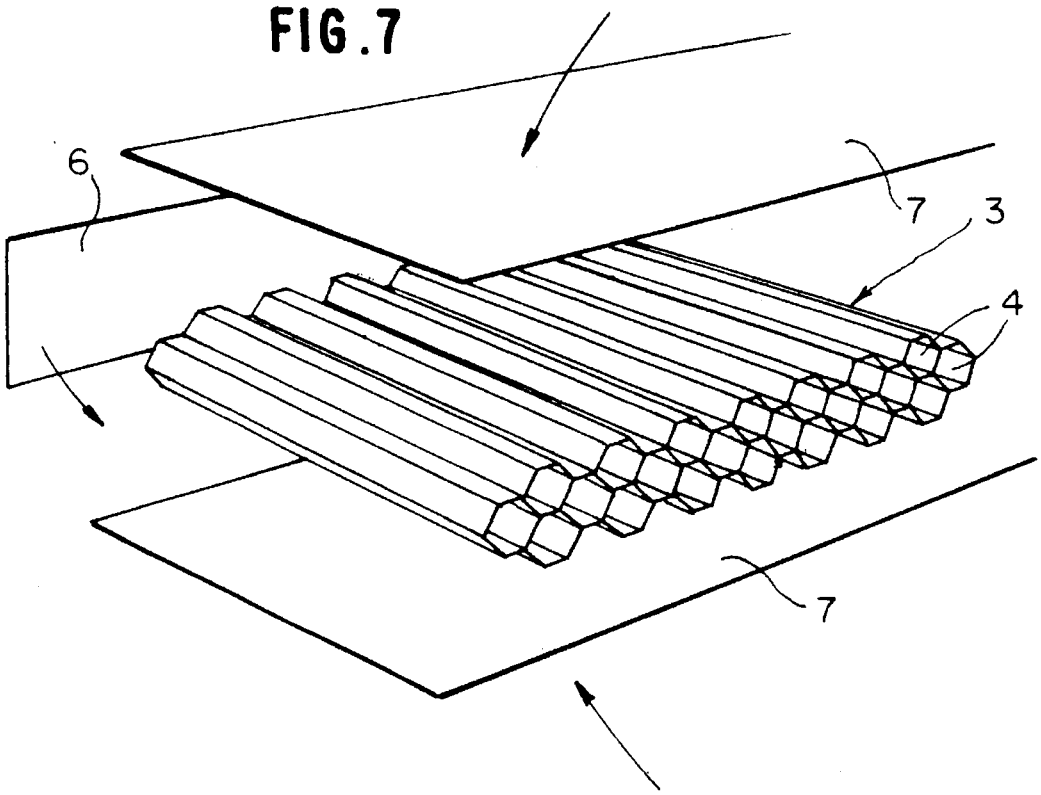

With reference to FIG. 6, at the end portions of length Δy of each strip 2, there are formed tabs 5 which are folded by 90° either on one side or the other to define a contact plane for an additional sheet 6 (FIG. 7) which is glued to one end of structure 3 (FIG. 7) to close all the cells 4 at one of their ends.

Preferably, the two main faces of body 2 are also covered by two strips 7, for example of the same material of structure 3, but with a greater thickness.

Figure 8:
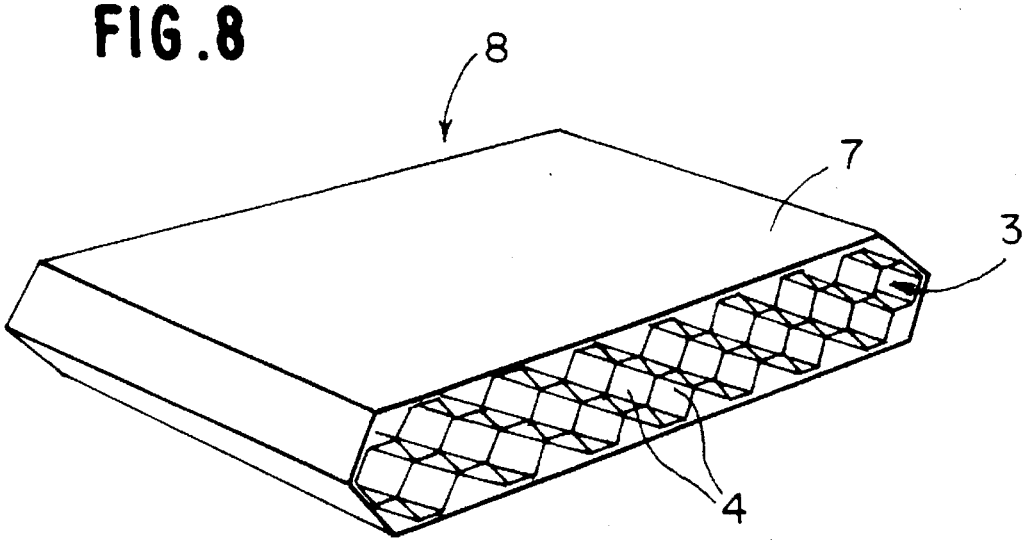
Figure 9:
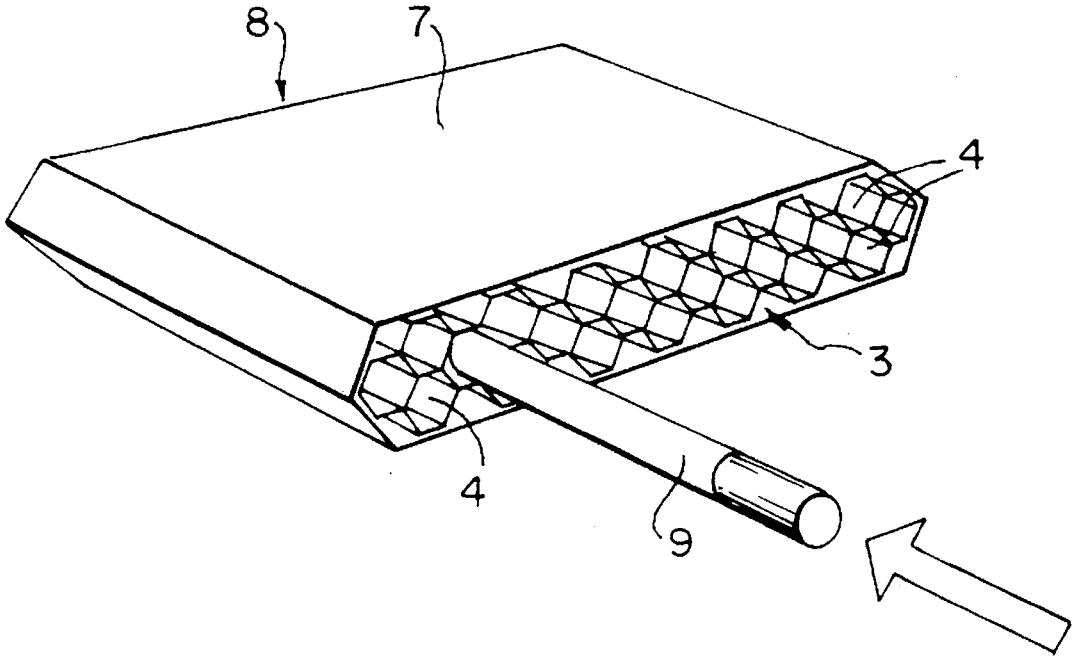
Figure 10:
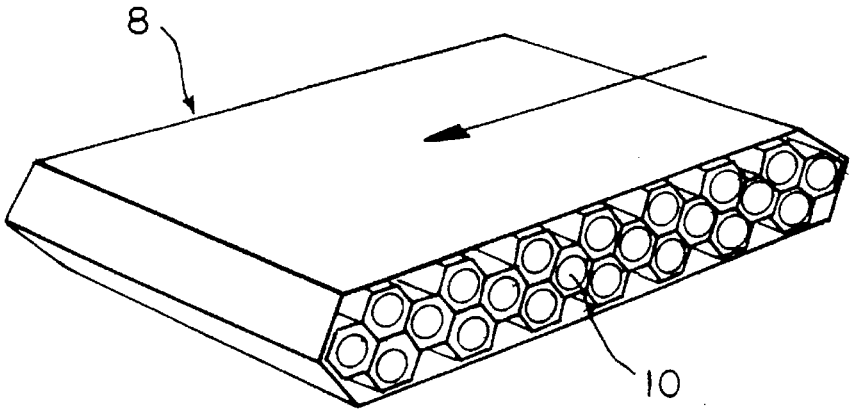
FIG. 10 shows a perspective view of the package according to the invention.
Figure 11:
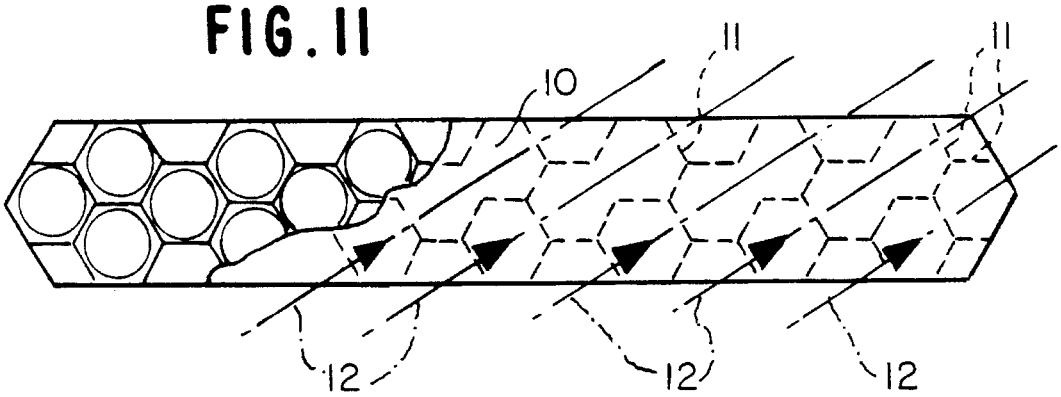
FIG. 11 is a front view at an enlarged scale of the package of FIG. 10.
Figure 12:
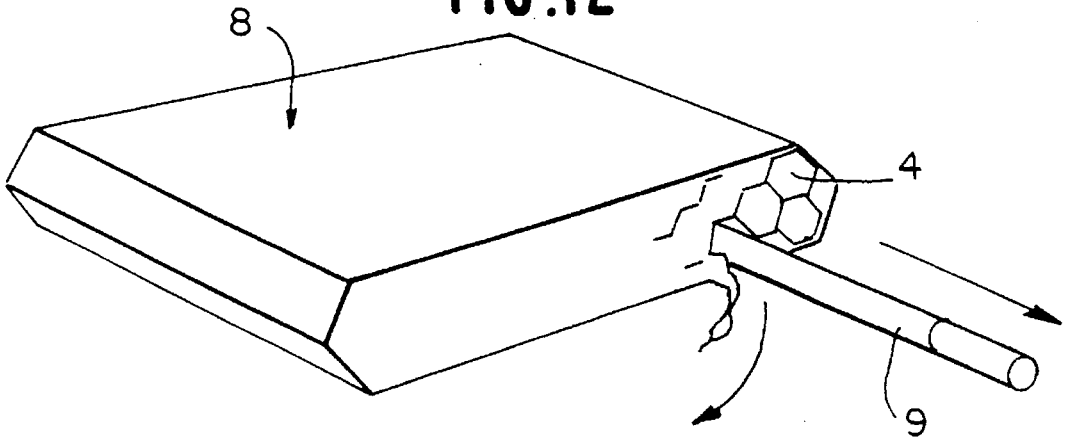
FIG. 12 is a perspective view which show the way of using the package of FIG. 10.

Naturally, the aforesaid operations may be carried out continuously and a portion of the structure 3 can then be cut corresponding to the shape that must be given to the single package for cigarettes, which at the end assumes the appearance indicated by 8 in FIG. 8. In this condition, the ends of the cells 4 opposite to the wall 6 are still opened and therefore allow the introduction of a respective cigarette 9 into each cell 4 (FIG. 9). Once the cigarettes 9 have been introduced into package 8, the opened side of the package is closed by a method similar to that described with reference to the opposite ends of the cells 4. Also in this case, therefore, there are formed tabs of a length Δy (not shown in FIG. 9) which are bent to allow a closing wall to be glued thereto. In this case the closing wall, designated by reference numeral 10 in FIG.11, has pre-cut lines 11 which allow the wall 10 to be ripped by removing each time only a portion thereof, so as to open only one cell 4 at a time. For example, with reference to FIG. 11, the pre-cut lines 11 may define strip portions arranged according to slanted directions 12, which can be removed in the way shown in FIG. 12.

As indicated above, the cigarette package thus obtained provides a number of advantages.

The structure of package 8 is rigid in the longitudinal direction of the cells 4, which keeps the integrity of the single cigarettes 9.

Furthermore, the structure provides a single packaging for each cigarette, so as to advantageously keep the flavour and ensure the order and protection of the cigarettes even when some of the cigarettes within the package have been used. Therefore, the beating to which the cigarettes of the known packages are subject when some of the cigarettes within the package have been used, with the resulting loss of tobacco and damages to the cigarettes, is avoided.

Figure 13:
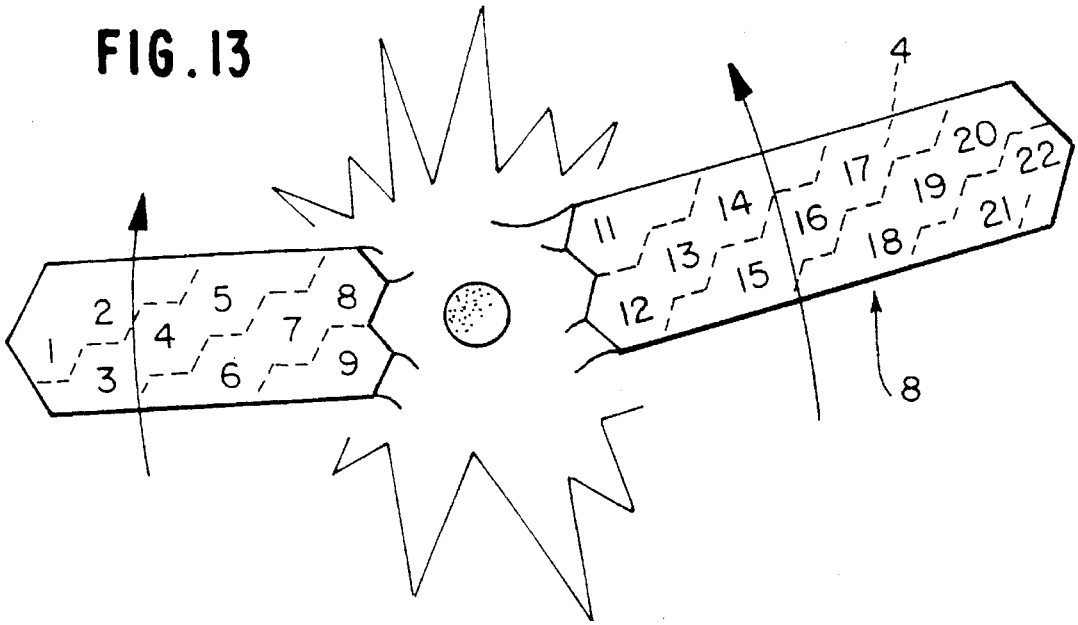
FIG. 13 is a front diagrammatic view at an enlarged scale which shows a further way of using the package of FIG. 10.

The structure of the package according to the invention allows the number of remaining cigarettes to be immediately perceived. If desired, it is possible to print a progressive number on the corresponding covering portion of each cell 4, as shown in FIG. 13. Also with reference to FIG. 13, the structure can be divided, with the loss of one or two cigarettes, so as to originate identical structures. This feature may become advantageous and convenient for the user, both for reducing the bulk of the package for a more convenient transportation, for example within a pocket of a garment and when he wishes to give it as a present to another person.

Figure 14:
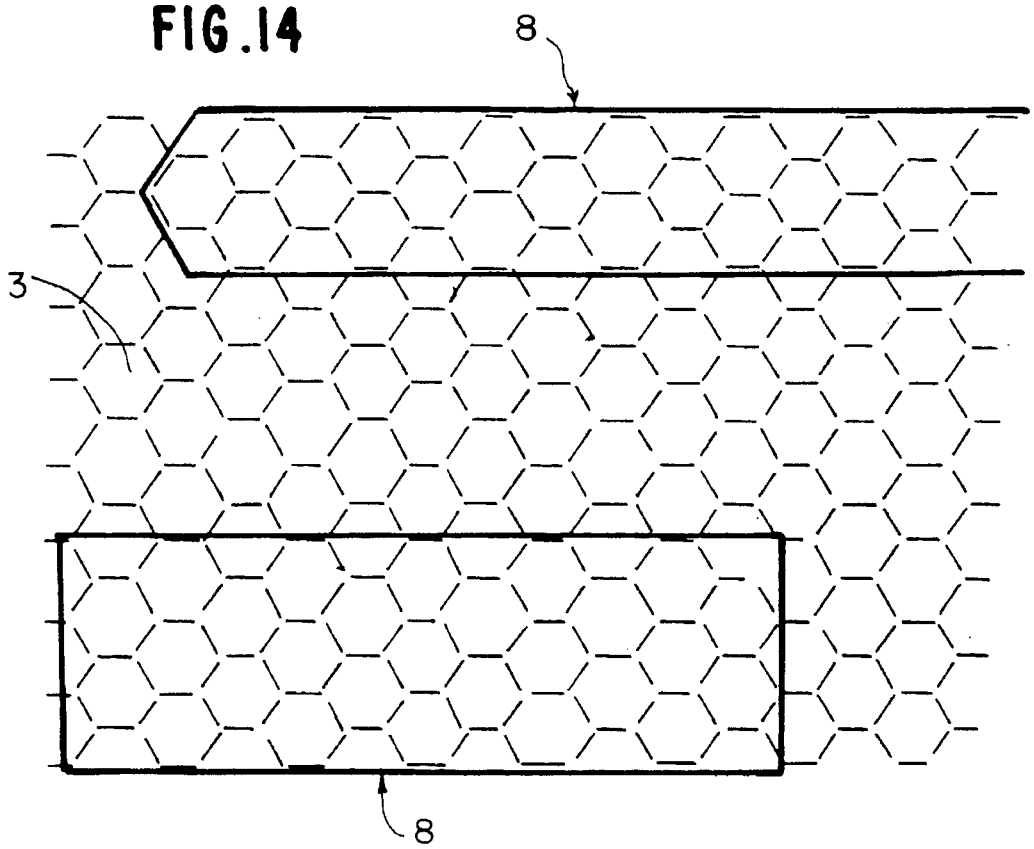
FIG. 14 is a front view of a honey-comb structure which can be used to produce packages according to the invention.
Figure 15:
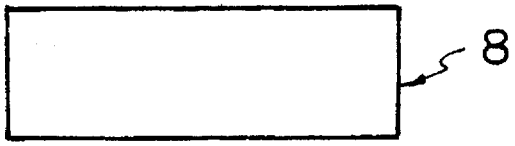
FIGS. 15–19 are front diagrammatic views of possible variants of the shape of the package according to the invention.
Figure 16:
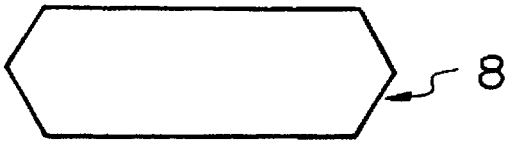
Figure 17:
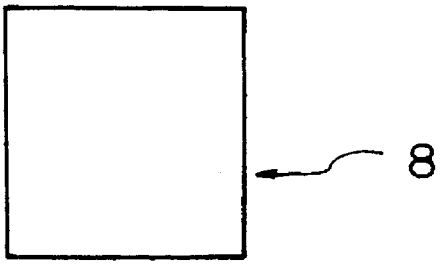
Figure 18:
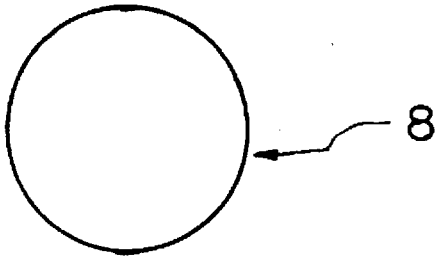
Figure 19:
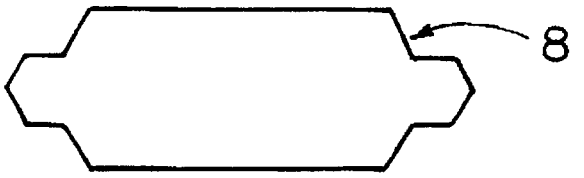

The honey-comb structure is modular in itself and lends itself to provide a large number of shapes without any variation in the rigidity of the whole unit. This feature has been diagrammatically shown in FIG. 14, where it appears that packages 8 of different shape may be obtained from the honey-comb structure 3.

FIGS. 15–19 show possible variants of the shape of package 8.

As already indicated above, the structure of the package according to the invention may be provided of a single material which of course may also be different from paper or light cardboard (for example an extruded plastic element may be provided for the honey-comb structure).

It is also possible to provide a structure of big size, to be used as service container for supplying containers of lower dimensions.

FIGS. 20–23 show four subsequent sections of an apparatus for the manufacture of the above described cigarette package by a continuous process.

Figure 20:
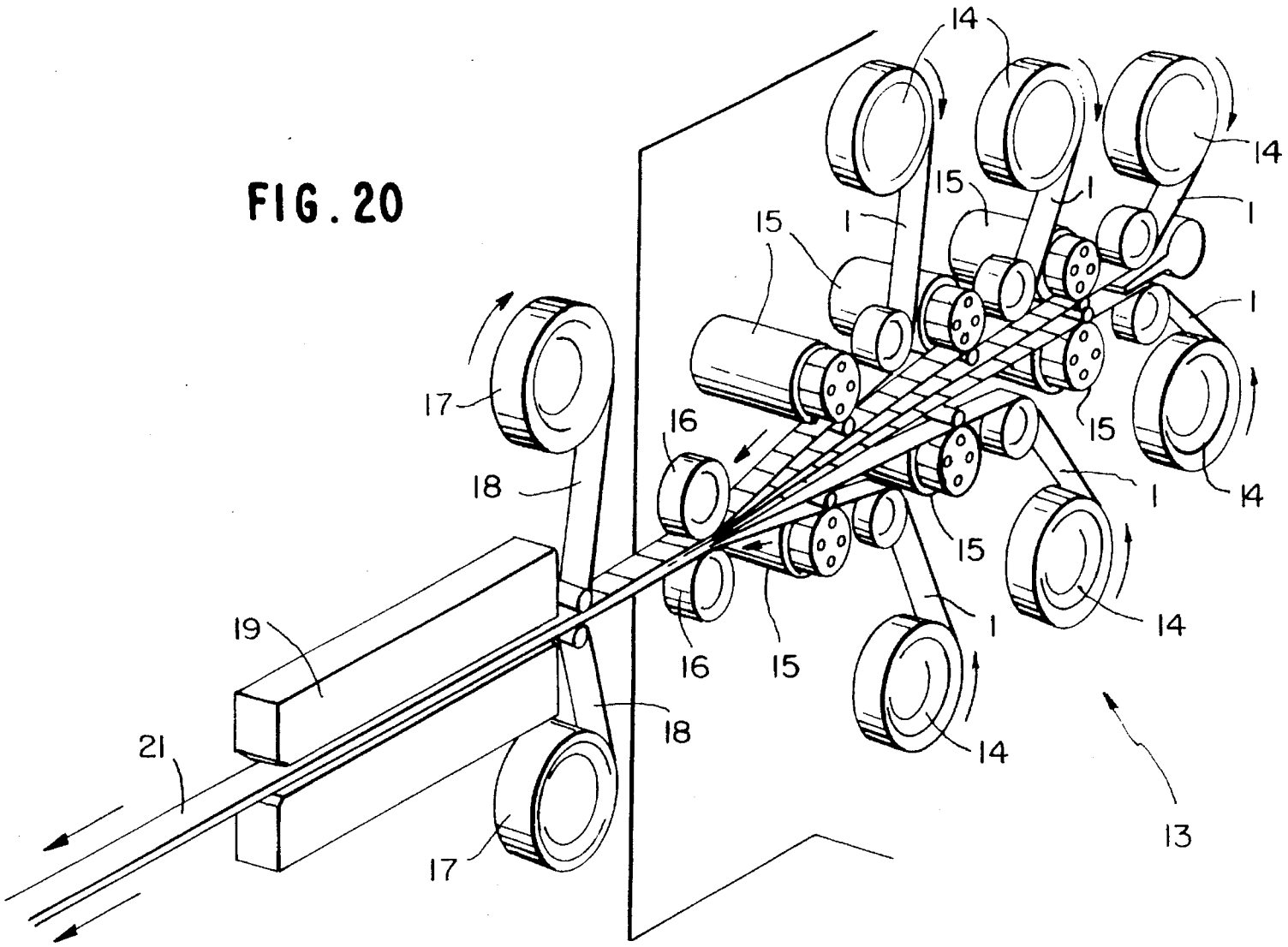
FIGS. 20–23 are diagrammatic perspective views which show an apparatus which can be used for the manufacture of the package according to the invention.

With reference to FIG. 20, numeral 13 designates an initial area of the apparatus according to the invention where bands 1 are prepared. The latter are unrolled from reels 14. The presentation in FIGS. 20–23 is diagrammatic. Therefore, the various rotating parts, such as reels 14, are shown without the associated supporting devices, which may be of any known type and whose arrangement will become obvious to the skilled men in the art.

With each band 1 there is further associated an apparatus 15, of a type known per se, adapted to deposit adhesive strips 2 onto bands 1. The bands 1 thus prepared are advanced through counter-rotating rollers 16 which press the bands 1 against each other causing bonding of the bands at the adhesive strips 2.

Downstream of rollers 16, there are arranged two reels 17 from which bands 18 unroll which are made of the material which is to form the outer cover 7. The band sandwich obtained thereby, designated by reference numeral 18 is advanced through a drying device 19, of a type known per se.

Figure 21:
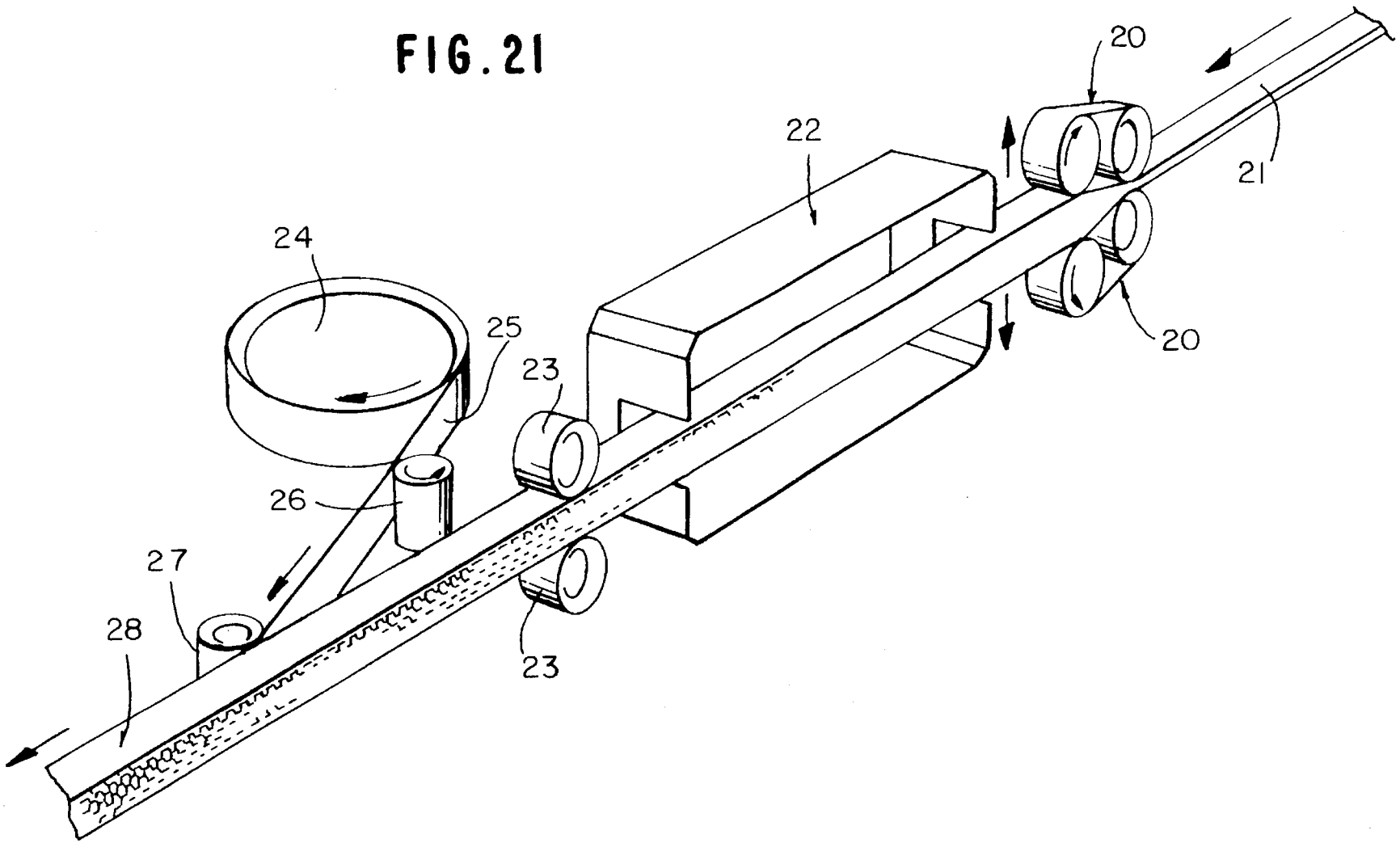

With reference now to FIG. 21, the band sandwich 18 is advanced between two endless belt conveyors 20, which are counter rotating relative to each other and provided with means to suck the bands of the sandwich so as to tend to move the two outer bands 18 apart from each other. The sandwich is then caused to pass through an expansion chamber 22 where the widening of the sandwich is made easier by a flow of pressurized air directed transversely, as already described above (FIG. 3), so as to define the honey-comb structure according to the invention.

The band obtained thereby is caused to pass through two sizing rollers 23. Downstream of the sizing rollers 23 there is provided a reel 24 from which a band 25 unrolls which is to form the bottom wall 6 of the package. The band 25 is coated with glue by a roller 26 and is then applied against the "bar" coming from rollers 23 by a pressing roller 27. Downstream of roller 27, therefore, a stable band 28 closed on three sides is obtained.

Figure 22:
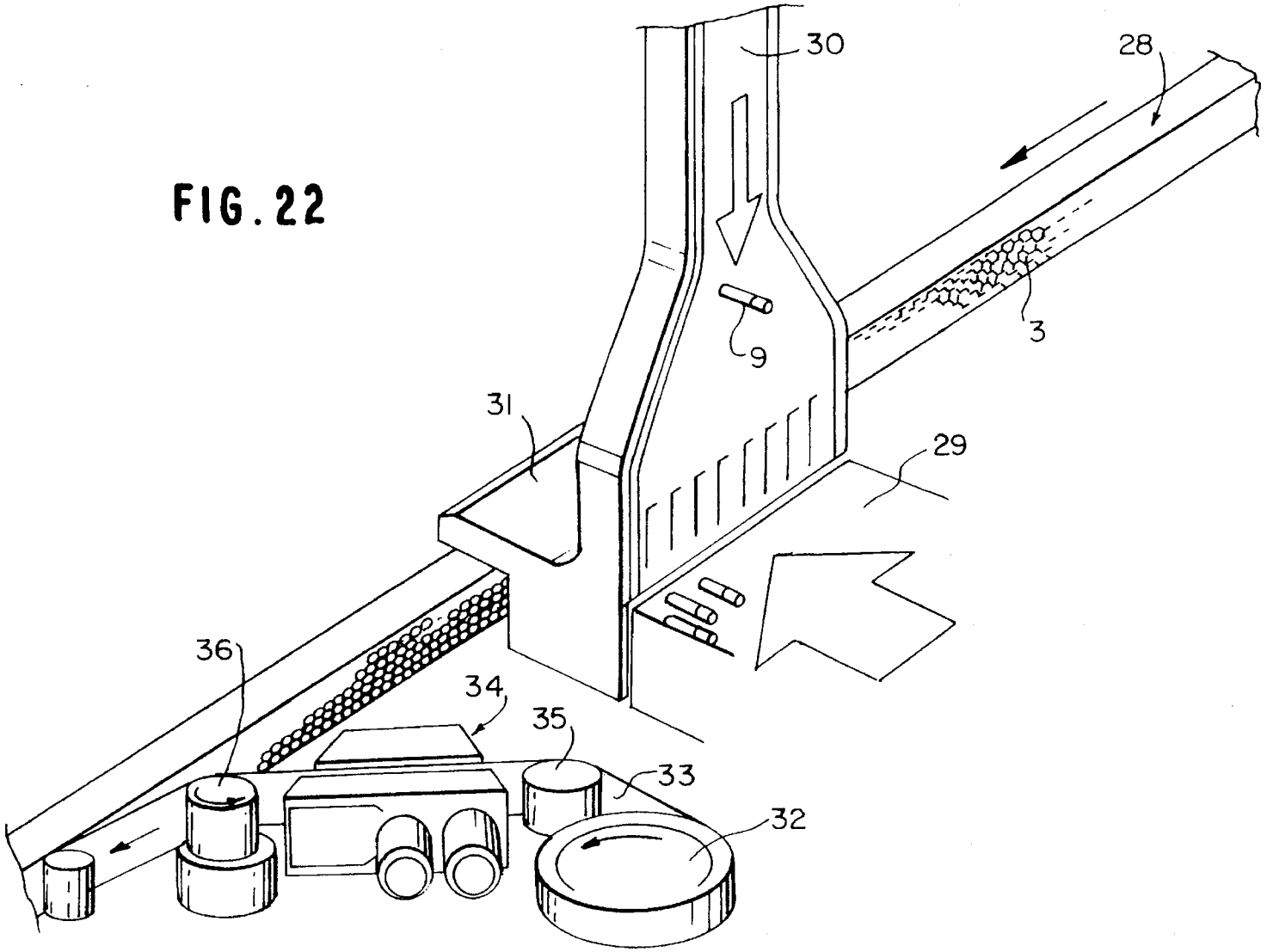

With reference now to FIG. 22, the stabilized band 28 arrives at a device 29 for introducing cigarettes and putting them in order, provided with a hopper 30 for feeding cigarettes 9 from above and with a device 31 for aligning the cigarettes and introducing them into cells 4 of the honey-comb structure 3.

Reference numeral 32 designates a reel from which a band 33 unrolls, which is made of the material which is to form the wall closing the cells 4. The band 33 passes through a cutting unit 34, which provides the pre-cut lines 11, after passing through an idle roller 35.

Reference numeral 36 designates a roller for pressing the band 33.

Figure 23:
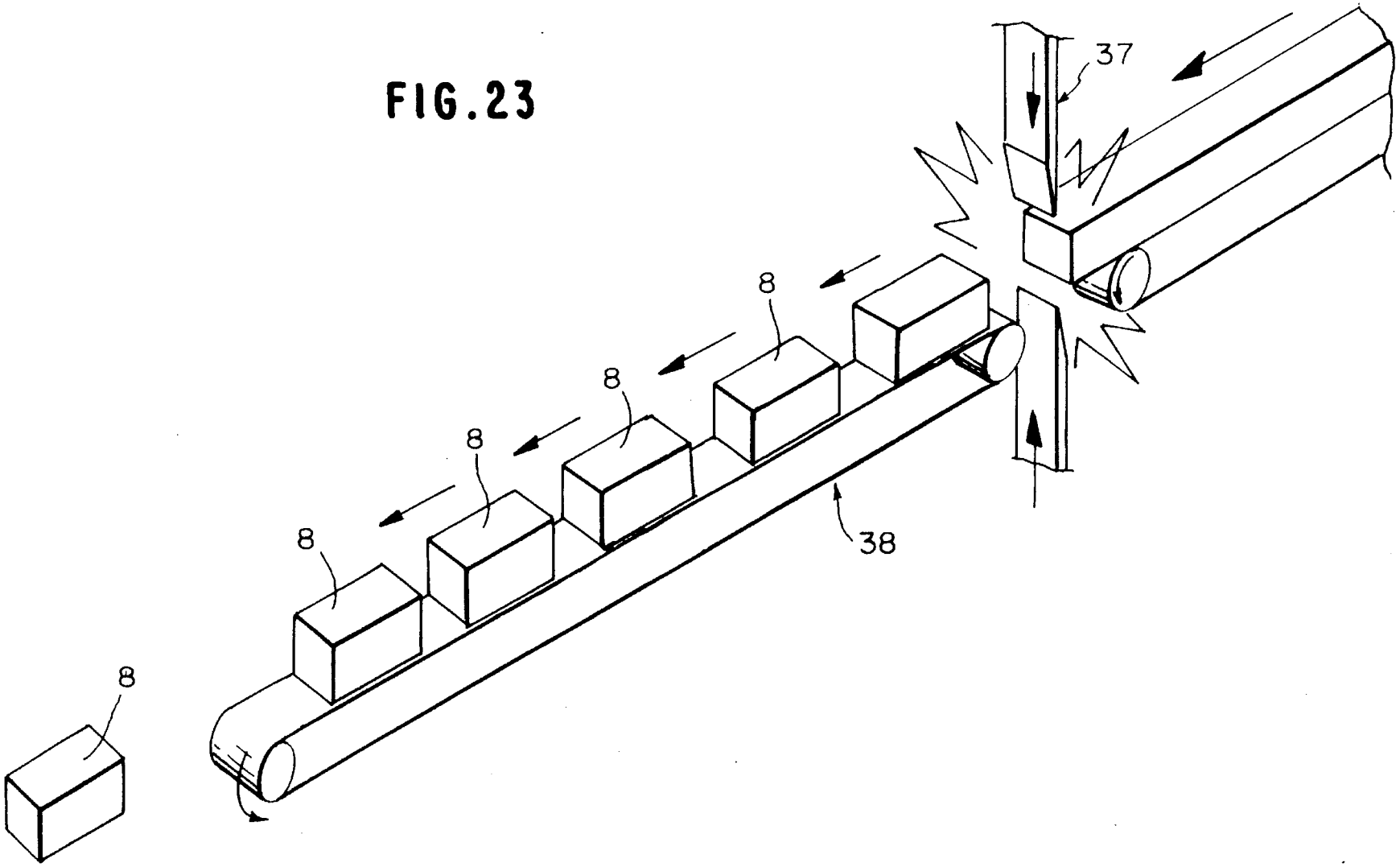

With reference to FIG. 23, the continuous "bar" obtained thereby is cut by a cutting device 37 so as to feed a plurality of separate packages 8 to a conveyor belt 38. The packages 8 are then unloaded on suitable devices which provide to packaging thereof.

Naturally, while the principle of the invention remains the same, the details of construction and the embodiments may widely vary with respect to what has been described and illustrated purely by way of example, without departing from the scope of the invention.

I claim:

1. Package for cigarettes comprising a honey-comb structure which defines a plurality of elongated parallel cells, each for receiving a respective cigarette, said structure further including two opposite walls which close said cells at their ends, at least one of said end walls being adapted to be opened to allow access to said cells, wherein the honey-comb structure is comprised of a plurality of sheets superimposed to each other, which are mutually bonded along strip portions thereof which are spaced apart from each other, and said sheets being spaced apart from each other between two adjacent strip portions, so as to define said cells, according to a honey-comb general arrangement, wherein the material forming said sheets and said end walls is light cardboard or paper, and wherein said end wall which can be opened has pre-cut lines arranged so as to define a plurality of removable strips arranged side by side according to parallel directions which are slanted with respect to the sides of the package.

2. Package according to claim 1, wherein said end wall which can be opened has pre-cut lines which allow removal only of the portion of this wall which closes each single cell.

3. Package according to claim 1, wherein said honey-comb structure is provided with a covering sheet on each of its two main faces.

* * * * *